United States Patent [19]

Kuhn

[11] Patent Number: 5,020,930

[45] Date of Patent: Jun. 4, 1991

[54] DISPENSER WITH REDUCTION TRANSMISSION

[75] Inventor: Peter H. A. N. Kuhn, Delft, Netherlands

[73] Assignee: Sara Lee/DE N.V., Netherlands

[21] Appl. No.: 468,732

[22] Filed: Jan. 23, 1990

[30] Foreign Application Priority Data

Jan. 24, 1989 [NL] Netherlands ..... 8900170

[51] Int. Cl.[5] ..... A45D 40/02; A47L 23/05

[52] U.S. Cl. ..... 401/146; 401/141; 401/150; 401/171; 401/176; 401/179; 401/181; 401/186; 401/262; 401/266; 222/213; 222/214

[58] Field of Search ..... 401/141, 143, 146, 150, 401/171, 176, 179, 181, 266, 186, 262; 222/212, 213, 214

[56] References Cited

U.S. PATENT DOCUMENTS

| | | | |
|---|---|---|---|
| 1,014,465 | 1/1912 | Hall | 222/213 UX |
| 1,260,139 | 3/1918 | Brown | 401/171 X |
| 4,413,759 | 11/1983 | Mettenbrink | 222/213 |
| 4,830,227 | 5/1989 | Ball et al. | 222/214 X |
| 4,946,076 | 8/1990 | Hackmann et al. | 222/212 X |

FOREIGN PATENT DOCUMENTS

| | | | |
|---|---|---|---|
| 193299 | 9/1986 | European Pat. Off. | 401/150 |
| 284166 | 3/1987 | European Pat. Off. | 401/176 |
| 282791 | 9/1988 | European Pat. Off. | 222/212 |
| 2261052 | 6/1974 | Fed. Rep. of Germany | 401/171 |
| 2917543 | 11/1979 | Fed. Rep. of Germany | 401/176 |

*Primary Examiner*—Steven A. Bratlie
*Attorney, Agent, or Firm*—Michael L. Keller

[57] ABSTRACT

A dispenser for viscous material, such as shoe polish, comprising a substantially cylindrical reservoir having near one reservoir end a filling discharge passage terminating in a distribution channel extending through a porous applicator. At least a part of the dispenser wall is deformable for pressing the filling out of the reservoir through the filling discharge passage into the distribution channel. The dispenser is characterized in that at the other end of the reservoir (16,24), there is provided a follower piston (6,28) which, while confining the filling at the discharge end of the reservoir, under the influence of a force exerted axially on the piston body (6,24), is movable stepwise in the direction of the filling discharge passage (9,29). The dispenser is further provided with pumping means operative upon deformation of the deformable portion (3,34) of the dispenser wall (2,25), which portion is resilient.

7 Claims, 2 Drawing Sheets

DISPENSER WITH REDUCTION TRANSMISSION

In similar known dispensers for among other things shoe polish, the reservoir is formed by a tube having an applicator in the form of a sponge body provided around the discharge passage, in which body the distribution channel is formed. By squeezing the tube, a quantity of filling is introduced into the distribution channel and can then be spread over a surface to be treated, e.g. a shoe, by means of the sponge. A problem inherent in such known dispensers is that it is difficult always to introduce the same small quantity of filling into the distribution channel in the applicator by squeezing the reservoir wall.

It is an object of the present invention to provide a dispenser which does not have this drawback.

To that effect, there is provided, according to the present invention, in a dispenser of the type described above, a follower piston near the other end of the reservoir, which follower piston, with confinement of the filling at the discharge end of the reservoir, is movable stepwise under the influence of a force exerted axially on the piston body in the direction of the filling discharge passage and the dispenser is further provided with pumping means operative upon deformation of said deformable portion of the dispenser wall, which deformable portion is resilient.

Because, unlike a tube, whether made of resilient synthetic plastics material or of plastically deformable metal, only a given part of the dispenser wall is resiliently deformable, a force of deformation exerted on the dispenser will always result only in a predetermined reduction of the reservoir volume. Because, moreover, the follower piston always keeps the filling confined, this given reduction of the reservoir volume will also always result in the same amount of filling being pumped out.

In a further elaboration of the present invention, a reduction transmission is provided between the deformable part of the dispenser wall and the pumping means, so that with a relatively coarse deformation of the deformable part of the dispenser wall, always a proportional, be it much smaller, amount of filling being dispensed.

In a practical embodiment of the dispenser, it is provided with a rigid, cylindrical inner wall with a closed end and an end closed by the follower piston, together forming the reservoir boundaries, as well as an outer wall which is axially resiliently deformable to a limited extent and carries the porous applicator, while the discharge passage is a tube extending from the distribution channel in the applicator through the annular follower piston, to a point near the opposite end of the reservoir, said follower piston being composed of a piston portion with scraper edges in sliding engagement with the inner wall of the reservoir and with the discharge passage tube and a spider spring portion provided on the side of the piston portion away from the filling, said spider spring having inner and outer edges both fitted with radially extending resilient fingers slanting away from the piston portion and respectively engaging with the discharge tube and the reservoir wall.

When the dispenser is axially compressed as far as possible the rigid cylindrical inner wall is displaced relatively to the discharge tube, while due to the specific position of the radial fingers of the spider spring supporting the piston portion, the follower piston will be clamped down on the discharge tube and slide over the cylindrical dispenser wall. When the force exerted is removed and the dispenser springs back to its starting position, the spider spring clamps down on the cylindrical dispenser wall and slides over the discharge tube. During the compression of the dispenser filling is pumped out through the discharge tube, and during the expansion of the dispenser the piston follows the filling.

When, according to the present invention, the outer wall of the dispenser is provided with a circumferential corrugated fold defining the axial compressibility of the dispenser, the dispenser can be grasped and squeezed at the top, thereby introducing a fixed amount of filling into the applicator.

When, in accordance with a further feature according to the present invention, the reduction transmission is provided between the rigid cylindrical reservoir wall and the discharge tube and formed as a spring lever system whose inner ends are connected flexibly to the discharge tube, whose outer ends are kept by resilient resetting means in contact with the rigid cylindrical dispenser inner wall and which are supported on fulcrums near the discharge tube, the levers will pivot on said fulcrums upon axial compression of the dispenser, whereby a substantial downward displacement of the outer ends effects a small upward displacement of the discharge tube. Thus there is effected a reduced transmission of the movement through the distance of axial compression to the discharge tube, so that a relatively small amount of filling is dispensed.

In a constructively simple embodiment of the present invention, the resilient resetting means are formed by resilient elements starting from the outer ends of the levers, having free ends supported within the dispenser and being bent in axial cross section.

In a different embodiment of the present invention, the dispenser is provided with a double-walled dispenser portion with a tubular inner wall extending between the filling discharge passage of the reservoir and the distribution channel in the porous applicator and both the outer wall and the inner wall are resiliently deformable at least locally and are interconnected by cross members transmitting radial forces, with the filling discharge passage being provided with a non-return valve opening towards the inner space defined by the inner wall.

In this embodiment, the space enclosed by the inner wall functions as a pump chamber of a combined suction and delivery pump. When the deformable portion of the outer wall is compressed, the inner wall, too, is compressed and the volume of the pump chamber is reduced. The non-return valve is then closed and prevents backflow of the mass contained in the pump chamber and a quantity thereof is expelled to the applicator. When the inner wall springs back to the non-deformed position, a subatmospheric pressure is produced in the reservoir, which pulls the follower piston in the direction of the filling discharge passage.

For forming a reduction transmission between the deformable portions of the outer wall and the inner wall, according to the present invention, the proportions of the deformable portions of the outer wall and the inner wall and the bending strength of the or each cross member connecting said deformable wall portions, can be chosen in such a manner that a deformation of the deformable portion of the outer wall results in a smaller deformation of the deformable portion of the inner wall.

Some embodiments of the dispenser according to the present invention will now be described, by way of example, with reference to the accompanying drawings, in which.

Figure 3:
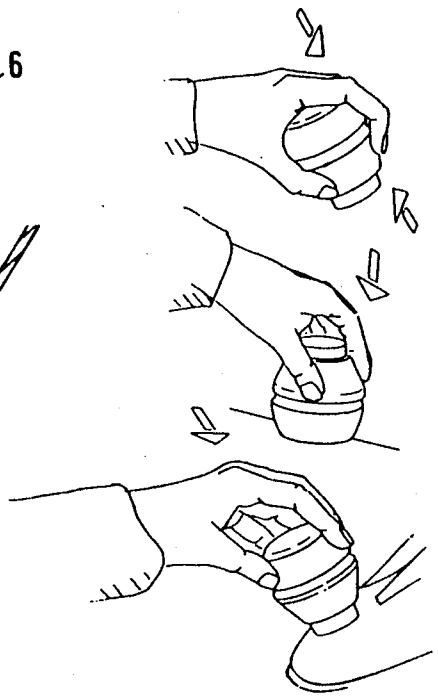
FIG. 3 shows the different manners of handling the dispenser while a dosed quantity of the dispenser's filling is being evenly spread over a surface to be treated.
Figure 2:
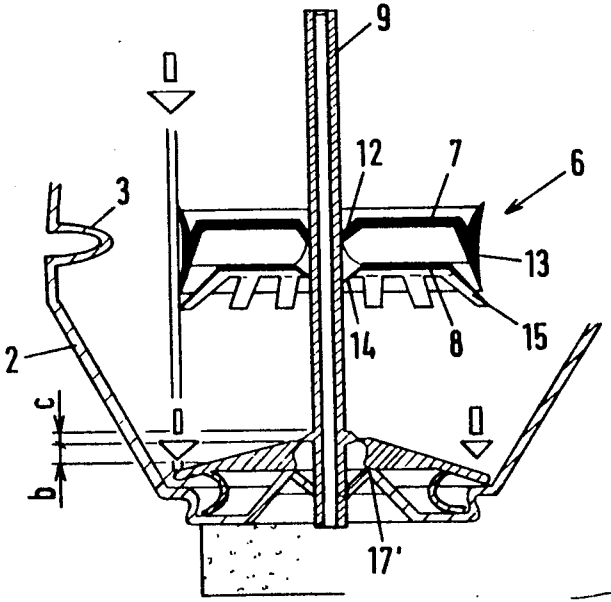
FIG. 2 shows a detail of the dispenser shown in FIG. 1, illustrating the reduction transmission.
Figure 1:
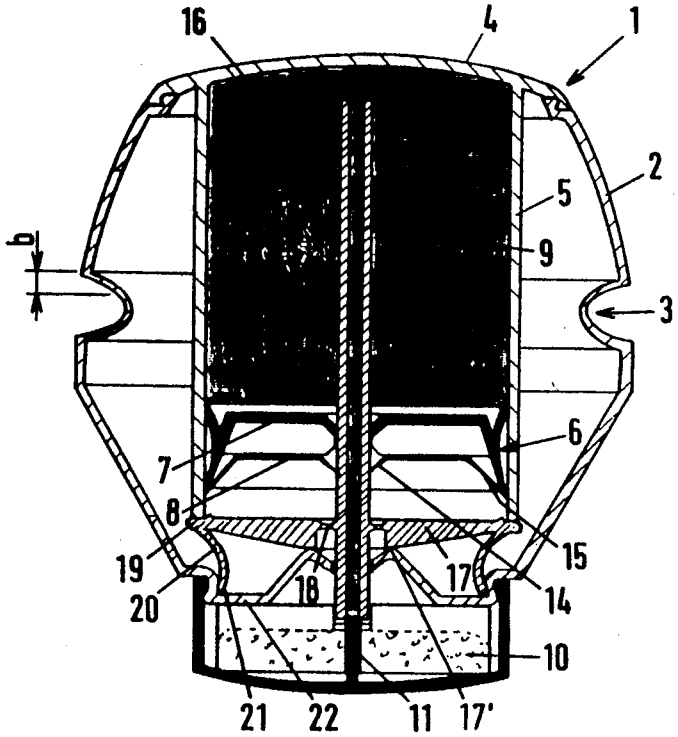
FIG. 1 is a diagrammatic view of an axial cross section of the dispenser in a first embodiment.

In the embodiment shown in FIGS. 1–3, the dispenser 1 comprises a convex outer wall 2 having a circumferential corrugated fold 3. The convex outer wall 2 is connected through an upper end wall 4 to a rigid cylindrical inner wall 5, which is closed at one end by the upper end wall 4 and at the other end by a follower piston 6 composed of an annular piston portion 7 and a spider spring 8.

A filling discharge tube 9 extends from a location near the upper end wall 4 into a sponge body 10 attached to the dispenser outer wall 2 and within which a distribution channel 11 extends.

The piston portion 7 slides with an inner scraper edge 12 over discharge tube 9 and with an outer scraper edge 13 along the cylindrical dispenser inner wall 5. Spider spring 8 clamps down on tube 9 with radial fingers 14 slanting away from piston portion 7 and against inner wall 5 with similar fingers 15.

Upon axial compression of the outer wall 2, inner wall 5 moves downwards relatively to tube 9, and due to the specific position of fingers 14 and 15, inner wall 5 slides over spider spring 8 while this element clamps down on tube 9. When outer wall 2 axially expands again and inner wall 5 moves relatively upwards, spider spring 8 and hence also piston portion 7, are taken along with inner wall 5, thereby sliding over discharge tube 9. The effect is that when the dispenser is compressed, the filling, such as shoe polish, is pressed out of the reservoir space 16 through discharge tube 9 in distribution channel 11 into the applicator sponge 10 and when the dispenser axially expands again the volume reduction in reservoir 16 is compensated for by a proportional advance of follower piston 7, 8.

A reduction transmission between the movement of inner wall 5 and that of tube 9 comprises spring levers 17 connected flexibly to tube 9 at 18 and whose outer ends 19 are disposed directly underneath the cylindrical inner wall 5. Provided underneath outer ends 19 is a resetting member in the form of a member 20 starting from a lever and bent in axial cross section, the free end 21 of which bears on the dispenser bottom 22. As shown in FIG. 2, upon axial compression of the dispenser outer wall 2 over a distance -b-, each lever is pivoted downwards on a fulcrum 17', whereby discharge tube 9 is pushed upwards through a distance -c-, which is much smaller than -b-. Thus complete compression of dispenser 1 will result in a small displacement of follower piston 7,8 and in a small volume of material being pumped out of the reservoir.

FIG. 3 shows that dispenser 1 can be used in different manners, either by grasping the entire spherical dispenser from the top, squeezing it axially in the hand, and spreading the quantity of material fed to the applicator, e.g. shoe polish, or by grasping the spherical dispenser 1 only at the top, and dispensing and simultaneously spreading the polish by pressing the dispenser against the surface to be treated.

Figure 5:
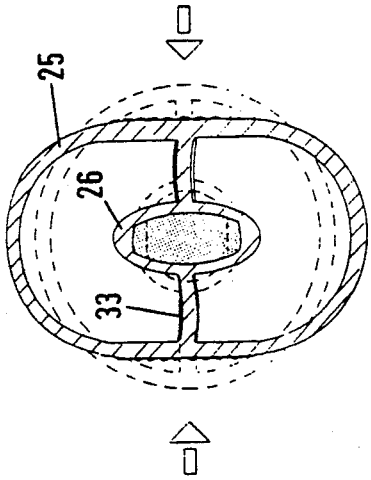
FIG. 5 is a cross-sectional view taken on the line V—V of FIG. 4.
Figure 4:
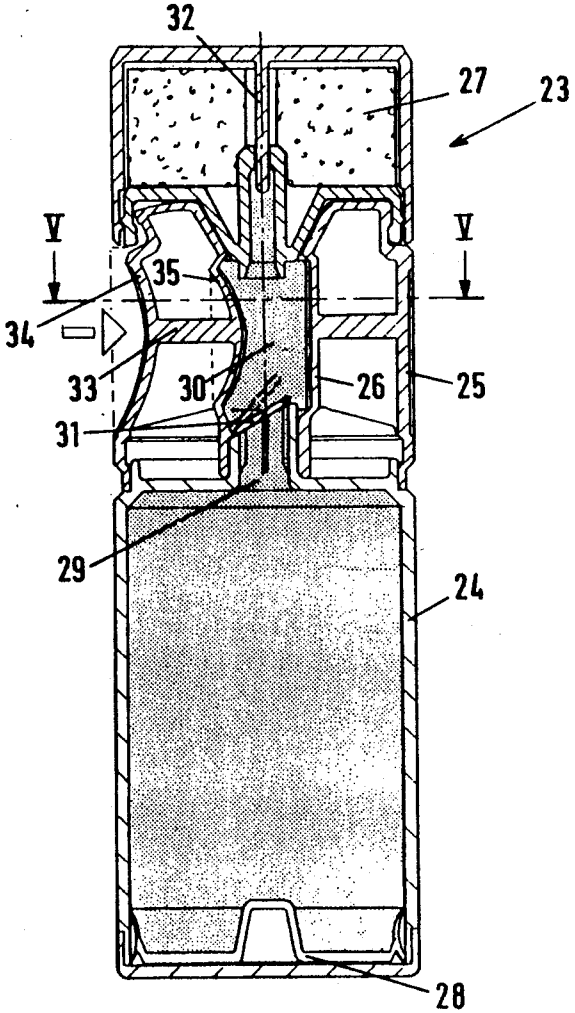
FIG. 4 is a view similar to FIG. 1 and showing a second embodiment of the dispenser.

In the embodiment shown in FIGS. 4–6, the dispenser 23 has the form of a cylindrical flask with a cylindrical reservoir portion 24, a double-walled pumping portion with an outer wall 25 and an inner wall 26, and an applicator sponge 27. A follower piston 28 is movable within reservoir 24. A filling discharge passage 29 extends from reservoir portion 24 to the space enclosed by inner wall 26, forming a pump chamber 30, with a non-return valve 31 at passage 29. Pump chamber 30 terminates in a distribution channel 32 in sponge 27.

The inner wall 26 and the outer wall 25 of the double-walled portion are deformable at least locally and interconnected by cross members 33.

As shown by arrows, compression of a deformable portion 34 of outer wall 25 will result in a smaller deformation of a deformable portion 35 of inner wall 26 and hence effect a comparatively slight reduction of the pump chamber volume, thereby dispensing a small amount of material.

When portion 34 of outer wall 25 is released the pump chamber volume is increased. Although in that case material is being sucked into the pump chamber from both ends, practically only material from the reservoir will be supplied through the opened non-return valve 31 owing to the comparatively small cross-sectional area of distribution channel 32.

FIG. 5 shows that with a proper dimensioning of inner wall 26 and outer wall 25 and at a bending strength of cross members 33 adapted thereto, only a substantial compression of outer wall 25 will result in such a deformation of inner wall 26 that material is actually being dispensed.

Figure 6A:
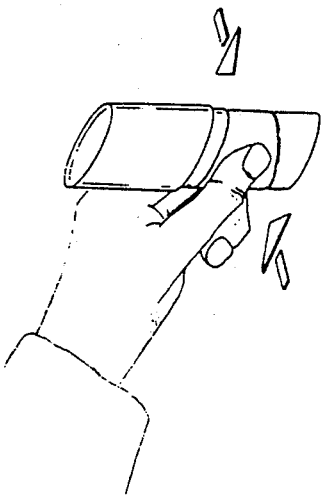
FIGS. 6A and 6B show different possibilities of grasping the dispenser according to FIG. 4 while a dosed quantity of filling is being spread.
Figure 6B:
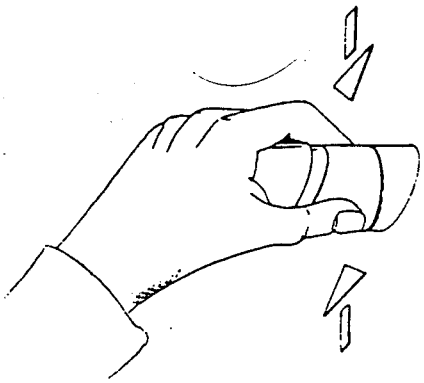

FIGS. 6A and 6B show the dispensing flask being grasped from the top and from aside.

I claim:

1. A dispenser for viscous material, such as shoe polish, comprising a substantially cylindrical reservoir having near one reservoir end a filling discharge passage terminating in a distribution channel extending through a porous applicator, and wherein at least a part of the dispenser wall is deformable for pressing the filling out of the reservoir through the filling discharge passage into the distribution channel, wherein at the other end of the reservoir, there is provided a follower piston which, while confining the filling at the discharge end of the reservoir, under the influence of a force exerted axially on said piston is movable stepwise in the direction of the filling discharge passage, the dispenser being further provided with pumping means operative upon deformable of the deformable portion of the dispenser wall, said portion being resilient, and further including a reduction transmission between the deformable portion of the dispenser wall and the pumping means.

2. A dispenser as claimed in claim 1, wherein said dispenser is provided with a rigid, cylindrical inner wall having a closed end and an end closed by the follower piston together forming the boundaries of the reservoir, as well as an outer wall, which is axially resiliently deformable to a limited extent and which carries the porous applicator, while the discharge passage is a tube, which extends from the distribution channel in the applicator through the annular follower piston to a point near the opposite end of the reservoir, the follower piston being composed of a piston portion with scraper edges slidingly engaging with the reservoir inner wall and with the discharge passage tube and spider spring portion disposed on the side of piston portion away from the filling and both the inner edge and the outer edge of which are fitted with radially extending fingers which, slanting away from piston portion, respectively engage with said discharge tube and said reservoir wall.

3. A dispenser as claimed in claim 2 wherein the outer wall of the dispenser is provided with a circumferential corrugated fold defining the axial compressibility of the dispenser.

4. A dispenser as claimed in claim 2, wherein the reduction transmission is provided between the rigid, cylindrical reservoir wall and the discharge tube and is formed by a spring lever system whose inner ends are flexibly connected to discharge tube, whose outer ends are kept by resilient resetting means in contact with the rigid, cylindrical dispenser inner wall and which bear on a fulcrum near the discharge tube.

5. A dispenser as claimed in claim 4, wherein the resilient resetting means are formed by resilient elements starting from the outer ends of levers, and having free ends supported within the dispenser and being bent in axial cross section.

6. A dispenser as claimed in claim 1, wherein a double-walled dispenser portion whose tubular inner wall extends between the filling discharge passage of the reservoir and the distribution channel in the porous applicator and both the outer wall and the inner wall of which are resiliently deformable at least locally and are interconnected by transverse members transmitting radial forces, the filling discharge passage being provided with a non-return valve opening towards the space defined by the inner wall.

7. A dispenser as claimed in claim 6 wherein the proportions of the deformable portions of the outer wall and the inner wall and the bending strength of the or each transverse member connecting said deformable wall portions are chosen in such a manner that a deformation of the deformable portion of the outer wall results in a smaller deformation of the deformable portion of the inner wall.

* * * * *